US006984614B1

(12) United States Patent
Als

(10) Patent No.: US 6,984,614 B1
(45) Date of Patent: Jan. 10, 2006

(54) COMPOSITION AND METHOD FOR REMOVING DEPOSITS

(76) Inventor: Jerome S. Als, Horizon Dr Bel Air La Ronbin, San Fernando (TT)

( * ) Notice: Subject to any disclaimer, the term of this patent is extended or adjusted under 35 U.S.C. 154(b) by 0 days.

(21) Appl. No.: 11/035,864

(22) Filed: Jan. 10, 2005

(51) Int. Cl.
*C11D 7/06* (2006.01)
*C11D 7/08* (2006.01)
*C11D 3/18* (2006.01)

(52) U.S. Cl. ..... 510/188; 510/207; 510/213; 510/225; 510/245; 510/253; 510/271; 510/272; 510/435; 134/38; 134/39; 134/40

(58) Field of Classification Search ..... 510/207, 510/213, 225, 245, 253, 271, 272, 435, 188; 134/38, 39, 40
See application file for complete search history.

(56) References Cited

U.S. PATENT DOCUMENTS 3,279,541 A 10/1966 Knox et al.
3,724,552 A * 4/1973 Snavely, Jr. ..... 166/304
4,089,703 A 5/1978 White
4,755,230 A 7/1988 Ashton et al.
4,775,498 A 10/1988 Gentilcore
5,346,339 A * 9/1994 Himes et al. ..... 405/171
5,725,678 A * 3/1998 Cannon et al. ..... 134/1
6,176,243 B1 1/2001 Blunk
6,756,021 B2 6/2004 Botrel
6,849,581 B1 * 2/2005 Thompson et al. ..... 507/118

* cited by examiner

*Primary Examiner*—Charles Boyer
(74) *Attorney, Agent, or Firm*—Browning Bushman P.C.

(57) ABSTRACT

A composition for removing paraffin, wax, or asphaltine deposits from the surface of a crude oil transmission system, such as a downhole tubular, a pipeline, or a surface tank, includes an aqueous sodium hydroxide solution containing from 18% to 25% by weight sodium hydroxide. The composition further includes an acetic acid solution containing from 30% to 55% by weight acetic acid compared to the sodium hydroxide, and a liquid aromatic hydrocarbon having from 6 to 10 carbon atoms and from 15% to 40% by weight compared to the sodium hydroxide. According to the method of the invention, the aqueous sodium hydroxide solution may be metered in a downhole tubular or a pipeline separate from the acetic acid solution, such that heat generated by the mixed composition is generated within the downhole tubular or the pipeline.

20 Claims, No Drawings

COMPOSITION AND METHOD FOR REMOVING DEPOSITS

FIELD OF THE INVENTION

The present invention relates to compositions and techniques for removing paraffin, wax, or asphaltine deposits from the surface of the downhole tubular, or pipeline, or storage tank. More particularly, the present invention relates to a composition and method which may be reliably used in a safe manner to generate a chemical reaction and controlled heating to assist in removal of the deposits.

BACKGROUND OF THE INVENTION

The petroleum industry has long struggled with the problem of removing deposits of paraffin, asphaltines, and resins in oil producing formations, and in surface production systems such as pipelines and storage tanks. Prior art techniques for removing these deposits include various chemicals and mechanical cleaning techniques.

Organic deposits are initially in solution within the crude oil which is produced from the reservoir. This oil is pumped from the well and up a tubing string, out through the wellhead and to the separation facilities to oil storage facilities. During the production and transport of the crude oils, the equilibrium of the solution is altered, and paraffin waxes, resins, and other organic materials become less soluble and precipitate out of the solution, and are then deposited on the walls of the transport systems. These deposits accumulate sufficiently to restrict the oil flow, thereby resulting in lower oil production and thus reduced net profits. To improve the production flow rate, the deposits must be periodically removed.

Prior art methods to remove such deposits involve the use of xylene, toluene, and other aromatic based solvents, which may be mixed with selected dispersants to solubilize the deposits. Special chemical blends have been proposed that generate heat as a result of an exothermic reaction, but these blends often require a substantial amount of surface preparation, mixing time, or downhole circulation time. Accordingly, techniques which use selected chemicals to produce an exothermic reaction and thereby remove deposits from wells and pipelines have not been favored for many applications.

U.S. Pat. No. 3,279,541 discloses a method of removing paraffins and asphaltines from a well. An inorganic salt or base which evolves a large amount of heat upon the addition of water is preferred as the heat generating solution. Disclosed materials include aluminum chloride, magnesium chloride, calcium chloride, sodium hydroxide, and potassium hydroxide. An inorganic salt such as calcium chloride may be added to water to cause a rise in the temperature of the water in the range of 200° F.

U.S. Pat. No. 6,756,021 discloses a device for the elimination of paraffin hydrate deposits in oilfield drilling equipment. An annular decomposition chamber may be mounted and sealed around a section of piping. The chamber contains a catalyst that promotes decomposition of the reactants.

U.S. Pat. No. 4,755,230 discloses another method of removing paraffin deposits from the interior of a hydrocarbon transmission conduit. An isolated length of the conduit receives an emulsified mixture of an aqueous solution and a hydrocarbon solution. In-situ nitrogen generating components and a buffered pH adjuster abate the reaction time to effect temperature melting of the paraffin deposits.

U.S. Pat. No. 4,775,498 discloses an oil and water emulsion with an organic solvent and agents selected to promote stable foamed emulsion.

U.S. Pat. No. 4,089,703 discloses a hot detergent process. One of the two solutions includes concentrated sulphuric acid and a foam stabilizer.

U.S. Pat. No. 6,176,243 discloses a composition for paraffin removal. The composition includes an aliphatic alcohol and an organic acid selected from acetic acid, citric acid or formic acid.

The disadvantages of prior art compositions and techniques, and particularly those techniques designed to generate exothermic reactions to heat the downhole deposits, involve concerns with respect to the safety and the handling of the various composition chemicals at a well site or along a pipeline. Moreover, prior art exothermic techniques have not reliably produced a controlled reaction, and instead the actual reaction may produce more or less heat than desired. Producing more heat than desired can have severe adverse consequences on the walls of the equipment being cleaned, while a temperature reaction lower than desired is not likely to be effective at removing the paraffin deposits. In addition to the risks associated with utilizing prior art chemical compositions for this purpose, some of the compositions are very expensive and are thus not cost effective when used on numerous wells and pipelines. Other chemicals cause potential adverse consequences with the downhole equipment, such as corrosion. Still other compositions inherently involve lengthy processing and/or mixing times of the chemicals, which are not favored, particularly at the well site or the pipeline.

The disadvantages of the prior art are overcome by the present invention, which discloses a relatively simple and highly reliable composition for obtaining a controlled exothermic reaction to generate a desired amount of heat to remove paraffin, asphaltines and resins along a surface of a crude oil transmission system.

SUMMARY OF THE INVENTION

In one embodiment, the composition is provided for removing paraffin, wax, or asphaltine deposits on a surface of a crude oil transmission system, including a downhole tubular, a pipeline or a storage tank. The composition comprises an aqueous sodium hydroxide solution containing from 18% to 25% by weight sodium hydroxide. An acetic acid solution contains from 30% to 55% by weight acetic acid compared to the sodium hydroxide, and a liquid aromatic hydrocarbon having from 6 to 10 carbon atoms and from 15 to 40% by weight aromatic hydrocarbon compared to the sodium hydroxide. According to the method of the invention, the chemicals may be mixed then pumped into the well or pipeline, or alternatively may be separately pumped into the well or pipeline for mixing downhole or downstream to generate the desired exothermic reaction.

DESCRIPTION OF THE ILLUSTRATED EMBODIMENTS

A composition is provided for removing paraffins, wax, asphaltines, and other deposits from a surface of crude oil transmission systems, such as a downhole tubular, a pipeline, or a storage tank. The composition includes a water/sodium hydroxide solution, with the sodium hydroxide being from about 18% to about 25% by weight of the water/sodium hydroxide solution. The composition further includes an acetic acid solution which contains from 30% to 55% by weight acetic acid compared to the sodium hydroxide. The acetic acid solution contains at least 90% by weight acetic acid, and preferably contains by weight approximately 99% acetic acid. The composition further comprises a liquid aromatic hydrocarbon having from 6 to 10 carbon atoms and from 15% to 40% by weight compared to the sodium hydroxide.

In many embodiments, the aqueous sodium hydroxide solution contains from 20% to 23% by weight sodium hydroxide, and the acetic acid solution contains from 30% to 40% by weight acetic acid compared to the sodium hydroxide. The liquid aromatic hydrocarbon may be from 15% to 30% by weight of the sodium hydroxide.

In a suitable embodiment, a liquid aromatic hydrocarbon includes at least one of xylene and toluene. The liquid aromatic hydrocarbon further may include dispersants to solubilize the deposits.

According to the method of the invention, the composition is provided as discussed above, and is mixed to generate heat. Deposits are then contacted with the mixed solution, which generates heat to remove the deposits. The aqueous sodium hydroxide solution may be input separately to one of the downhole tubular or a pipeline from the acetic acid solution, such that heat generated by the mixed composition is generated within the downhole tubular or within the pipeline. More particularly, the aqueous sodium hydroxide solution and a liquid aromatic hydrocarbon may be mixed at the surface and pumped into one of the downhole tubular and pipeline, and thereafter the acetic acid solution pumped into a downhole tubular or the pipeline. A plot of temperature versus time subsequent to mixing for the composition has been developed. After approximately one minute, the temperature is about 195° F., and after about 5 minutes, the temperature is about 182° F. The temperature then slowly drops, and in 5 minute increments starting with 10 minutes is approximately 175° F., 168° F., 162° F., 158° F., 153° F., and 152° F.

In many applications, the composition will be efficient for removing paraffin or organic materials from the interior walls. In other applications, conventional scraping methods or dispersant removal techniques may be used subsequent to the composition to assist in removal of deposits.

As one alternative, acetic acid anhydride may be combined with water to form the acetic acid.

A non-flammable, biodegradeable composition for the removal of deposits on the surfaces of crude oil transmission equipment is provided. The water-based composition includes sodium hydroxide, acetic acid, and an aromatic solvent. Most importantly, the exothermic reaction generates heat that can be controlled within narrow ranges, e.g., from 185° F. to 194° F. If desired, heating and melting of organic and paraffin deposits may frequently occur at a melting point below 170° F.

An improved technique for removing paraffins and other deposits that may accumulate on the walls of tubing, tanks, and pipeline surfaces benefits from fast reaction times and easily handling of composition ingredients. If desired, a delayed reaction may be controlled to extend the reaction time by pumping the sodium hydroxide solution into a well and then pumping the acetic acid into the well.

A flow meter may be used to ensure the desired ratio of composition ingredients which are pumped into the well. When coming into contact with an area of deposition, the composition solubilizes and reduces the viscosity of the deposits. Restrictions are thereby removed and flow is restored to maximize oil production output. Once the composition has removed the paraffin or organic materials, the composition is disposed from the system.

The composition when mixed is capable of generating an output heat of from about 170° F. to 195° F., which temperature is suitable to solubilize most hard, organic materials such as greases, waxes, and asphaltines. The composition will not remain at elevated temperatures for extended periods under cold conditions, but typically will stay above 170° F. for over 20 minutes when used at temperatures lower than 175° F.

The composition has a pH of from 10 to 13, thus producing a non-corrosive mixture. The composition desirably has minimal or no effect on crude oil emulsions. In a typical application, the composition may generate approximately 2 million BTU's of energy.

The foregoing disclosure and description of the invention is illustrative and explanatory of preferred embodiments. It would be appreciated by those skilled in the art that various changes in the composition, as well in the method or combination of features discussed herein may be made without departing from the spirit of the invention, which is defined by the following claims.

What is claimed is:

1. A composition for removing paraffin, wax or asphaltine deposits from a surface of a crude oil transmission system, the composition comprising:

an aqueous sodium hydroxide solution containing from 18% to 25% by weight sodium hydroxide;

an acetic acid solution containing from 30% to 55% by weight acetic acid compared to the sodium hydroxide; and a liquid aromatic hydrocarbon having from 6 to 10 carbon atoms and from 15% to 40% by weight compared to the sodium hydroxide.

2. A composition as defined in claim 1, wherein the acetic acid solution contains at least 90% by weight acetic acid.

3. A composition as defined in claim 2, wherein the acetic acid solution contains by weight approximately 99% acetic acid.

4. A composition as defined in claim 1, wherein the aqueous sodium hydroxide solution contains from 20% to 23% by weight sodium hydroxide.

5. A composition as defined in claim 1, wherein the acetic acid solution contains from 30% to 40% by weight acetic acid compared to the sodium hydroxide.

6. A composition as defined in claim 1, wherein the liquid aromatic hydrocarbon is from 15% to 30% by weight compared to the sodium hydroxide.

7. A composition as defined in claim 1, wherein the liquid aromatic hydrocarbon includes at least one of xylene and toluene.

8. A composition as defined in claim 1, wherein the liquid aromatic hydrocarbon further comprises dispersants to solubilize the deposits.

9. A composition as defined in claim 1, wherein the acetic acid is generated by mixing water with acetic acid anhydride.

10. A composition as defined in claim 1, wherein the aqueous sodium hydroxide solution contains from 20% to 23% by weight sodium hydroxide, the acetic acid solution contains from 30% to 40% by weight acetic acid compared to the sodium hydroxide, and the liquid aromatic hydrocarbon is from 15% to 30% by weight compared to the sodium hydroxide.

11. A method of removing paraffin, wax or asphaltine deposits from a surface of a crude oil transmission system, the method comprising:

providing a composition comprising an aqueous sodium hydroxide solution containing from 18% to 25% by weight sodium hydroxide, an acetic acid solution containing from 30% to 55% by weight acetic acid compared to the sodium hydroxide, and a liquid aromatic hydrocarbon having from 6 to 10 carbon atoms and from 15% to 40% by weight compared to the sodium hydroxide; and mixing the composition to generate heat; and contacting the deposits with the mixed solution.

12. A method as defined in claim 11, wherein the aqueous sodium hydroxide solution is input separately to one of a downhole tubular or a pipeline from the acetic acid solution, such that heat generated by the mixed composition is generated within the one of the downhole tubular or the pipeline.

13. A method as defined in claim 12, wherein the aqueous sodium hydroxide solution and liquid aromatic hydrocarbon are mixed at the surface and pumped into one of the downhole tubular and the pipeline; and thereafter the acetic acid solution is pumped into one of the downhole tubular and the pipeline.

14. A method as defined in claim 12, wherein the aqueous sodium hydroxide solution and the acetic acid solution are separately metered into one of the downhole tubular and the pipeline.

15. A method as defined in claim 11, wherein the acetic acid solution contains by weight approximately 99% acetic acid.

16. A method as defined in claim 11, wherein the aqueous sodium hydroxide solution contains from 20% to 23% by weight sodium hydroxide.

17. A method as defined in claim 11, wherein the acetic acid solution contains from 30% to 40% by weight acetic acid compared to the sodium hydroxide.

18. A method as defined in claim 11, wherein the liquid aromatic hydrocarbon is from 15% to 30% by weight compared to the sodium hydroxide.

19. A method as defined in claim 11, wherein the liquid aromatic hydrocarbon includes at least one of xylene and toluene, and further comprises dispersants to solubilize the deposits.

20. A method as defined in claim 11, wherein the acetic acid is generated by mixing water with acetic acid anhydride.

* * * * *